United States Patent [19]

Breidenbach et al.

[11] Patent Number: 4,929,179

[45] Date of Patent: May 29, 1990

[54] ROOF STRUCTURE

[75] Inventors: Dieter Breidenbach, Bochum-Stiepel; Hans Oldengott, Hamm; Burckard Vitt, Lohmar, all of Fed. Rep. of Germany

[73] Assignee: Ruhrkohle AG, Essen, Fed. Rep. of Germany

[21] Appl. No.: 258,549

[22] Filed: Oct. 17, 1988

[51] Int. Cl.[5] ..... F27D 1/00

[52] U.S. Cl. ..... 432/247; 432/250; 432/251; 432/252; 110/331

[58] Field of Search ..... 432/247, 250–252; 110/181, 331, 338

[56] References Cited

U.S. PATENT DOCUMENTS

| | | | |
|---|---|---|---|
| 1,132,028 | 3/1915 | O'Donnell . | |
| 2,125,192 | 7/1938 | Morlock | 72/37 |
| 2,137,040 | 8/1937 | Woodson | 263/42 |
| 2,154,414 | 3/1938 | Teeters | 263/46 |
| 2,236,920 | 2/1959 | Robertson | 110/99 |
| 3,489,401 | 6/1968 | Merdian et al. | 263/46 |
| 4,081,236 | 3/1978 | Corbett | 432/3 |
| 4,213,753 | 7/1980 | Negroni et al. | 437/247 |
| 4,325,694 | 4/1982 | Bergman | 432/247 |
| 4,529,178 | 7/1985 | Hosbein et al. | 266/283 |
| 4,666,404 | 5/1987 | Suey | 432/250 |

FOREIGN PATENT DOCUMENTS

| | | |
|---|---|---|
| 3242998 | 11/1982 | Fed. Rep. of Germany . |
| 3426149 | 7/1984 | Fed. Rep. of Germany . |

*Primary Examiner*—Henry C. Yuen

*Attorney, Agent, or Firm*—Nils H. Ljungman

[57] ABSTRACT

A roof structure has a plurality of layers of heat resistant material, at least a first of the layers including a first brick layer, at least a second of the layers above the first of the layers including a heat resistant compound, and the heat resistant compound being unshaped when initially installed above the first of the layers. A method of forming a roof structure in an opening between side walls of a chamber includes the steps of installing at least one layer of bricks in the opening directly above the chamber, applying at least one layer of a first concrete in an unshaped form in the opening over the at least one layer of the bricks, tamping the at least one layer of the first concrete at at least a first predetermined temperature, and allowing the at least one layer of the first concrete to harden.

14 Claims, 1 Drawing Sheet

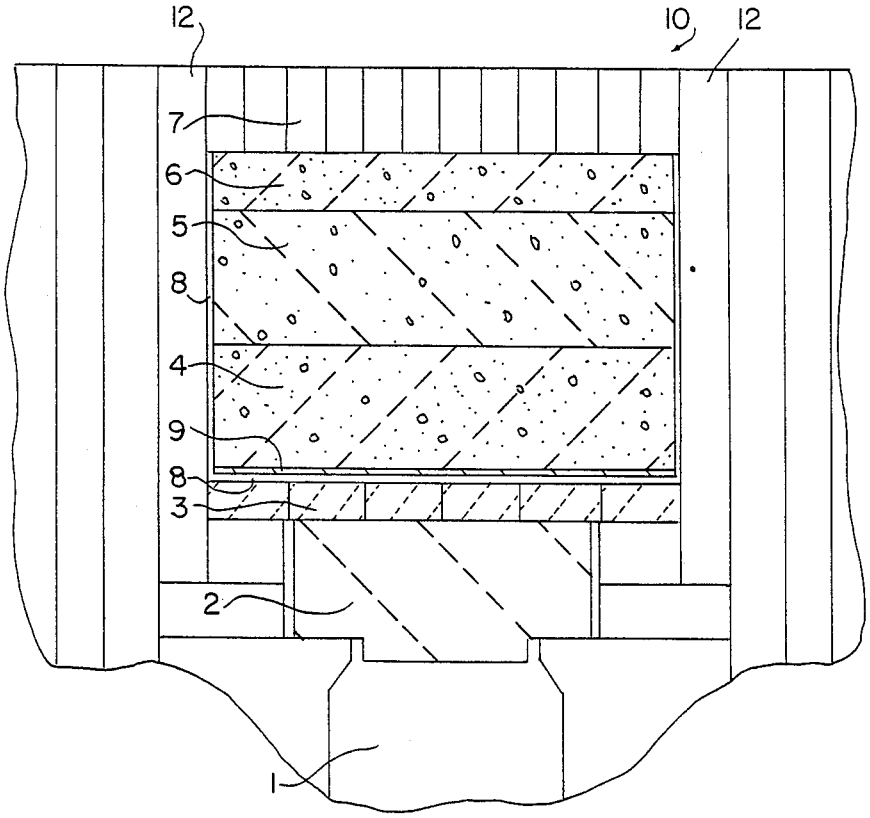
12
10
12
7
6
5
8
4
9
8
3
2
1

ROOF STRUCTURE

BACKGROUND OF THE INVENTION

1. Field of the Invention

This invention relates to a roof structure and, more specifically, to such a roof structure which includes several layers of heat resistant material.

2. Description of the Prior Art

It is not uncommon for a roof structure to be formed of several courses or layers of bricks which have heat resistant characteristics. The roof structure is located basically in an opening which is between and defined by the upper ends of the side walls of structure. The following sequence is frequently used to provide such a roof structure having heat resistant qualities. The bottommost layer of silica brick is laid in the lower part of the opening between the side walls and supported thereby. A layer of standard fireclay brick is laid over the silicon brick layer. The next layer would include lightweight refractory brick. A layer of standard insulating brick would then be laid on top of the lightweight refractory brick. Finally, the uppermost layer of the roof structure is formed by common red brick.

Although such roof structures have been employed in the past, it has always been recognized that the manufacture of heat resistant or refractory bricks of this type is very expensive. The expense of the refractory bricks is primarily due to the fact that so many special shapes are required. The special shapes are needed to insure proper integrity of the roof structure throughout extended use. In fact, it has also been found that the need for such integrity has significantly added to the design costs of providing such a roof structure because of the need to specifically design each of the many special shapes of refractory bricks. In addition to the design costs, the requirement for many shapes of the refractory bricks significantly extends the overall design-to-completion time. Since each of the different shapes must be specifically produced, the increased manufacturing time can significantly add to the overall cost of the project of providing the desired roof structure. Finally, when the refractory bricks are available, the actual assembly costs are elevated because of the additional labor time and skill required to assemble the roof structure with the refractory bricks having different shapes.

Even with such design requirements and care in assembly, there is a continuing concern that roof structures formed of such refractory brick will be susceptible to gas penetration after initial assembly and throughout extended use of the roof structure. Accordingly, any type of roof structure which can reduce the design, manufacture and assembly expenses and which would tend to remain more effective for preventing penetration of gas would clearly be desirable.

OBJECTS OF THE INVENTION

It is therefore an object of the invention to provide a roof structure which is less expensive to design, manufacture and construct.

It is another object to provide such a roof structure which significantly reduces the requirement for refractory bricks having many special shapes.

It is a further object to provide such a roof structure which effectively reduces or prevents the penetration of gas.

SUMMARY OF THE INVENTION

These and other objects of the invention are provided in a preferred embodiment thereof including a roof structure which has a plurality of layers of heat resistant material. At least a first of the layers includes a first brick layer. At least a second of the layers above the first of the layers includes a heat resistant compound. The heat resistant compound is unshaped when initially installed above the first of the layers.

The objects of the invention are also provided by a preferred method of forming a roof structure in an opening between side walls of a chamber. The method includes the step of installing at least one layer of bricks in the opening directly above the chamber. Further, there is included the step of applying at least one layer of a first concrete in the opening over the one layer of bricks. The method then includes the tamping of the one layer of the first concrete at at least a first predetermined temperature. Finally, the one layer of first concrete is allowed to harden.

The preferred invention has particular application to providing a roof structure which can serve as a coke oven roof which includes several layers of refractory material. Conventional coke oven roofs consist of several courses of refractory brick. The following sequence is frequently used; the bottommost layer is silica brick, with standard fireclay brick over that, then standard lightweight refractory brick, and standard insulating brick on top of that. The uppermost layer of the oven roof is formed by common red brick. The manufacture of refractory bricks is very expensive, primarily because so many special shapes are required. The object of the invention, therefore, is to reduce the construction expense for the manufacture of oven roofs.

According to the invention, the object is achieved by using, as far as possible, unshaped refractory compounds, in particular refractory concretes, instead of refractory bricks. Refractory compounds are compounds which an withstand temperatures of 1500° C. to 1700° C. They include fire-resisting compounds (up to 1500° C.) and highly refractory compounds (above 1700° C.). Refractory concretes are unshaped compounds with a concrete-hydraulic bond which at the appropriate conditions is converted to a ceramic bond at elevated temperatures. The refractory concretes can be introduced as tamping clays. One advantage of the use of tamping clays is that they make the production of special shapes unnecessary.

Refractory concretes are preferably used between the fireclay layer and the uppermost layer of bricks of the oven roof. Surprisingly, however, it has been discovered that the temperature in the oven roof is thereby lower than with comparable oven roofs made of refractory bricks. It has also been demonstrated that the oven roofs with the refractory concrete layers very effectively prevent the penetration of gas.

BRIEF DESCRIPTION OF THE DRAWING

The FIGURE illustrates a fragmentary, sectional view of a preferred roof structure including one embodiment of the invention.

DESCRIPTION OF THE PREFERRED EMBODIMENTS

The FIGURE shows a transverse cross section of a preferred roof structure 10 which is at right angles to the longitudinal direction of the oven. The oven chamber 1 is enclosed on both sides by side walls 12 and by the preferred roof structure or furnace roof 10 at the top thereof. The oven is 390 to 430 mm wide. The bottommost layer in the oven roof structure 10 comprises silica bricks 2. The silica bricks 2 are refractory bricks and form a layer which is 220 mm high in the preferred embodiment as illustrated. Above the silica bricks 2 are standard fireclay bricks 3. The standard fireclay bricks 3 are again refractory bricks. In contrast to an oven roof structure of the prior art with two courses of fireclay bricks, however, there is only one course of fireclay bricks 3. The thickness of the fireclay refractory bricks 3 is 70 mm. The oven roof structure is closed at top thereof by a layer of common red bricks 7. The common red bricks 7 in the top layer are laid lengthwise on their narrow side.

Between the layer of common red bricks 7, which has a conventional thickness of 130 mm, and the layer of fireclay bricks 3, there are various refractory concrete layers, in the following sequence from bottommost to topmost:

Light refractory concrete, insulating concrete, light refractory concrete.

The bottom layer 4 of light refractory concrete is 200 mm thick and the top layer 6 is 100 mm thick. The insulating concrete layer 5 in between is 250 mm thick.

The light refractory concrete layer has the following specification:

$Al_2O_3$ content: 26.6%
$SiO_2$ content: 45.7%
$Fe_2O_3$ content: 8.7%

| | | |
|---|---|---|
| Cold bending strength | 1000° C. | 17 kp/cm$^2$ |
| with preliminary firing | 1100° C. | 26 kp/cm$^2$ |
| Thermal conductivity at | 600° C. | 0.41 kcal/mh °C. |
| | 800° C. | 0.40 kcal/mh °C. |
| | 1000° C. | 0.43 kcal/mh °C. |

Refractoriness: SK 8 1295° C.
Max. use temperature: 1100° C.

The insulating concrete layer has the following specification:

$Al_2O_3$ content: 26.8%
$SiO_2$ content: 33.2%
$Fe_2O_3$ content: 11.9%

| | | |
|---|---|---|
| Cold bending strength | | 10 kp/cm$^2$ |
| with preliminary firing 110° C. | | |
| Thermal conductivity at | 400° C. | 0.15 kcal/mh °C. |
| | 600° C. | 0.17 kcal/mh °C. |
| | 800° C. | 0.19 kcal/mh °C. |

Refractoriness: SK 7 1270° C.
Max. use temperature: 1020° C.

Between the refractory concrete region and the other refractory bricks there is an expansion joint 8 of 10 mm. The expansion joint 8 is filled with a silicate fiber material (¾ inch ceramic fiber). The silicate layer forming the expansion joint 8 can be resealed if gas leaks occur. Moreover, in the horizontal section of the expansion joint 8 there is a metal foil 9 which, in the preferred embodiment, is an aluminum foil 0.3 mm thick. Such an expansion joint 8 guarantees that no expansion damage will occur when the masonry heats up. The aluminum foil also offers a significant insulating action and provides a seal against gas penetration.

The assembly of the oven wall proceeds normally, and the chamber roof bricks are laid in a manner well known in the coke oven art. Over them is laid the standard layer of fireclay bricks 3. The small heating walls (inspection hole walls) consist of fireclay bricks or prefabricated components. In the open spaces between the charging hole shafts and the top reflectors in the direction of the chamber axis and the heating walls in the direction of the battery axis, the refractory concrete is applied in layers. The installation is done by tamping the compound. The bottom layer of light refractory concrete or cement 4 is installed at a heating up temperature of approximately 55° C., while the insulating concrete 5 and the top layer of light refractory concrete 6 are applied at a heating up temperature of approximately 900° C. All the refractory concrete layers are kept moist for at least 30 hours after application. In one method of assembling the preferred roof structure 10, the bottom layer of light refractory concrete is substantially hardened after the 30 hours and the temperature is elevated to allow the application and tamping of the insulating concrete 5. After another 30 hours in which the insulating concrete 5 is kept moist, the top layer of light refractory concrete 6 is applied and tamped at the elevated temperature. Again, the top layer of the light refractory concrete 6 is kept moist for at least 30 hours. The temperatures and the other application parameters are determined as a function of the expansion behavior of the silica material used in the substructure.

Shortly before the chambers 1 are charged for the first time, the oven roof structure 10 is closed by the installation of the course in which the bricks 7 are laid lengthwise on their narrow side.

The roof according to the invention costs approximately 50% less than a roof with conventional masonry. Moreover, there is a significantly lower temperature in the oven roof and on the surface of the oven roof.

A number of patents disclose coke oven configurations and equipment associated with the operation thereof. These patents, which are incorporated as if disclosed in their entirety herein, include the following: U.S. Pat. Nos. 4,077,848; 4,244,786; 4,406,619; 4,512,080; 4,666,559; 4,673,463; and 4,749,446.

In summing up, one aspect of the invention resides broadly in a coke oven roof comprising several layers of refractory material, characterized by the fact that above one or more layers 2, 3 consisting of refractory bricks covering the oven chamber, there is at least one layer of unshaped refractory compound.

Another aspect of the invention resides broadly in the preferred unshaped refractory compound which is in the form of several layers of refractory concrete 4, 5, 6.

Yet another aspect of the invention resides broadly in a coke oven roof characterized by the fact that the refractory concrete has an $Al_2O_3$ content of 25 to 28%, an $SiO_2$ content of 30 to 50%, and an $Fe_2O_3$ content of 8 to 12%.

A further aspect of the invention resides broadly in a coke oven roof characterized by different refractory concrete layers on top of one another with various thicknesses and thermal conductivities.

A yet further aspect of the invention resides broadly in a coke oven roof characterized by the fact that there is a bottom refractory concrete layer 4 of light refractory concrete and an upper refractory concrete layer of light refractory concrete 6, and between them, a layer of insulating concrete 5.

Yet another further aspect of the invention resides broadly in a coke oven roof characterized by the fact that there is an expansion joint 8 between the refractory concrete layer and the refractory bricks.

An additional aspect of the invention resides broadly in a coke oven roof characterized by the fact that the expansion joint 8 is filled with a layer of silicate fiber material.

A yet additional aspect of the invention resides broadly in a coke oven roof characterized by the fact that there is a metal foil 9 in the expansion joint 8.

A further additional aspect of the invention resides broadly in a coke oven roof characterized by the fact that the metal foil 9 is aluminum.

A yet further additional aspect of the invention resides broadly in a coke oven roof characterized by the fact that the installation and treatment of the various refractory concrete layers is done as a function of the hot draft temperatures.

Another further additional aspect of the invention resides broadly in a coke oven roof characterized by the fact that the bottom light refractory concrete layer 4 is tamped at a heating up temperature of 50° to 60° C.

A yet another further additional aspect of the invention resides broadly in a coke oven roof characterized by the fact that the top layer of light refractory concrete and/or the intervening insulating concrete layer 5 is tamped at a temperature of 850° to 950° C.

Another yet further aspect of the invention resides broadly in a coke oven roof characterized by the fact that the oven roof is closed by the laying of the common red brick layer 7 shortly before the initial charging.

The invention as described hereinabove in the context of a preferred embodiment is not to be taken as limited to all of the provided details thereof, since modifications and variations thereof may be made without departing from the spirit and scope of the invention.

What is claimed is:

1. A roof structure comprising:

a plurality of layers of heat resistant material;

at least a first of said layers including a first brick layer;

said first brick layer including an upper surface;

said upper surface of said first brick layer being defined by a plurality of preformed refractory bricks disposed in a side-by-side manner;

at least a second of said layers above said first of said layers including a heat resistant compound;

said second of said layers extending across said roof structure;

said second of said layers including at least a portion of a said lower surface entirely supported by said first of said layers;

said lower surface of said second of said layers being generally supported at said upper surface of said first brick layer;

means for defining said lower surface of said second of said layers including said heat resistant compound of said second of said layers having been unshaped concrete when initially installed above said first brick layer of said first of said layers;

said first brick layer comprising support means for supporting said unshaped concrete at least when initially installed; and said means for defining said lower surface of said second of said layers including said upper surface of said first brick layer.

2. The roof structure according to claim 1, further including a top layer of common red brick above said plurality of layers of said heat resistant material.

3. The roof structure according to claim 1, wherein said second of said layers of said heat resistant compound includes a first concrete.

4. The roof structure according to claim 1, further including an expansion joint disposed at least between said second of said layers of said heat resistant compound and said first brick layer.

5. The roof structure according to claim 4, wherein said expansion joint is filled with a layer of silicate fiber material.

6. The roof structure according to claim 4, wherein said expansion joint includes a metal foil.

7. The roof structure according to claim 6, wherein said metal foil is aluminum.

8. The roof structure according to claim 3, further including at least a third of said layers of said heat resistant compound including a second concrete above said second of said layers of said first concrete, wherein said first concrete and said second concrete have different thermal conductivities and said second of said layers and said third of said layers have different thicknesses.

9. The roof structure according to claim 8, further including a fourth of said layers of said heat resistant compound including said first concrete above said third of said layers of said second concrete.

10. The roof structure according to claim 9, wherein said first brick layer includes refractory bricks, said first concrete is a light refractory concrete, and said second concrete is an insulating concrete.

11. The roof structure according to claim 10, wherein said light refractory concrete has a first thermal conductivity of about 0.41 kcal/mh°C. to about 0.43 kcal/mh°C. at temperatures from 600° C. to 1000° C. and said insulating concrete has a second thermal conductivity of about 0.15 kcal/mh°C. to about 0.19 kcal/mh°C. at temperatures from 400° C. to 800° C.

12. The roof structure according to claim 11, wherein said second of said layers has a predetermined thickness, said third of said layers has a thickness of about 1.25 of said predetermined thickness and said fourth of said layers has a thickness of about 0.5 of said predetermined thickness.

13. The roof structure according to claim 1, wherein said roof structure is for a coke oven chamber and said first of said layers is over said oven chamber.

14. The roof structure according to claim 2, wherein said heat resistant compound includes about 25% to about 28% of $Al_2O_3$, about 30% to about 50% of $SiO_2$, and about 8% to about 12% of $Fe_2O_3$.

* * * * *

UNITED STATES PATENT AND TRADEMARK OFFICE

CERTIFICATE OF CORRECTION

PATENT NO. : 4,929,179

DATED : May 29, 1990

INVENTOR(S) : Dieter Breidenbach et al.

It is certified that error appears in the above-identified patent and that said Letters Patent is hereby corrected as shown below:

ON TITLE PAGE:

Foreign Application Priority Data section, please add --May 21, 1987 [DE] Fed. Rep. of Germany 37 17 015.5.--

Item [63] please add --Continuation-in-part of PCT/EP88/00411 filed May 24, 1988.--

Signed and Sealed this

Tenth Day of March, 1992

*Attest:*

*Attesting Officer*

HARRY F. MANBECK, JR.

*Commissioner of Patents and Trademarks*